United States Patent [19]

Infusino et al.

[11] Patent Number: 4,646,368

[45] Date of Patent: Mar. 3, 1987

[54] ADJUSTABLE CHIN STRAP ASSEMBLY FOR ATHLETIC HELMETS

[75] Inventors: Ralph J. Infusino, Bartlett; Arthur M. Schulz, Roselle, both of Ill.

[73] Assignee: Riddell, Inc., Chicago, Ill.

[21] Appl. No.: 886,607

[22] Filed: Jul. 18, 1986

[51] Int. Cl.[4] ..... A42B 7/00

[52] U.S. Cl. ..... 2/421; 2/425

[58] Field of Search ..... 2/421, 417, 424, 425, 2/6, 9, 185 R

[56] References Cited

U.S. PATENT DOCUMENTS

| | | | |
|---|---|---|---|
| 2,769,176 | 11/1956 | Grancsay et al. | 2/421 |
| 3,166,761 | 1/1965 | Strohm | 2/421 |
| 3,311,921 | 4/1967 | Helm | 2/425 X |
| 3,619,813 | 11/1971 | Marchello | 2/421 |
| 4,044,400 | 8/1977 | Lewicki et al. | 2/421 |
| 4,051,556 | 10/1977 | Davenport et al. | 2/421 |
| 4,062,068 | 12/1977 | Davenport et al. | 2/421 |

*Primary Examiner*—Werner H. Schroeder
*Assistant Examiner*—J. L. Olds
*Attorney, Agent, or Firm*—McDougall, Hersh & Scott

[57] ABSTRACT

This invention relates to an adjustable chin strap assembly for use with athletic helmets. The chin strap assembly consists of a flexible piece of material which forms the chin cup, two support straps slideably attached to this chin cup, two adjustment pieces through which the support straps slideably intersect, and a set of four slideable snaps which releasibly fasten the support straps to an athletic helmet. The attitude of the flexible chin cup can be adjusted by sliding the adjustment piece along the lengths of the support straps to each side of the chin cup thereby allowing for maximum user comfort.

6 Claims, 4 Drawing Figures

ADJUSTABLE CHIN STRAP ASSEMBLY FOR ATHLETIC HELMETS

BACKGROUND OF THE INVENTION

This invention relates to the field of athletic equipment. More specifically, it relates to the field of chin straps for athletic helmets.

Generally, chin strap designs can be divided into two categories. The first category consists of chin straps which are worn under the chin at the junction of the chin and the throat. The second category of chin straps consists of designs which incorporate an identifiable chin cup or a pair of intersecting straps to fit over the wearer's chin. The invention disclosed herein is a manufacture of the second category.

Chin strap designs in both categories have been disclosed in the prior art. In the first category, for example, single strap designs have been disclosed in U.S. Pat. Nos. 4,044,400 (Lewicki, et al.), 4,461,044 (Reiterman, et al.), and 4,549,541 (Sundahl). In the second category, a chin strap is disclosed by Roberts in U.S. Pat. No. 2,277,994 which utilizes two bands to encircle the chin for the purpose of securing headgear for boxing or wrestling. Similar designs are disclosed by S. V. Grancsay, et al. in U.S. Pat. No. 2,769,176 and by L. Helm in U.S. Pat. No. 3,311,921. A chin cup design made of a double knit fabric with affixed stretchable nylon straps has been disclosed by Gooding in U.S. Pat. No. 3,916,446. Chin strap designs for football helmets have been disclosed by R. T. Jones in U.S. Pat. No. 2,867,811 (assigned to applicant) which uses a chin cup in lieu of a dual strap design, and by E. Strohm in U.S. Pat. No. 3,166,761 utilizing two webbed straps. However, none of these prior designs have been satisfactory when it is desired to provide adjustability for the chin strap assembly so that the angle of the chin cup can be adjusted according to the size and shape of the wearer's chin.

SUMMARY OF THE INVENTION

This invention involves a structure for providing adjustability for the chin cup. Specifically, there is provided a chin strap assembly comprising a chin cup made of flexible material which can be releasibly secured to a helmet using attachment snaps slideably located on dual support straps. The supporting straps slideably receive the chin cup and then intersect on each side of the chin cup through a slideable adjustment piece. The above design allows the wearer to adjust the chin strap assembly either by sliding the chin cup, the attachment snaps, or the adjustment pieces along the length of the support straps. Adjustment using the slideable adjustment pieces will provide a more comfortable fit. The user also has the option of sliding the chin cup relative to the support straps to maximize comfort. The over-all fit of the chin strap assembly can be made more snug by slideable adjustment of the attachment snaps at the ends of the support straps.

Therefore, it is an object of this invention to provide a simple and effective solution to the problems raised by chin straps of previous designs.

It is a more specific object of this invention to provide an adjustable chin strap assembly incorporating a flexible chin cup and associated adjustment piece for the achieving of maximum wearer comfort.

These and other objects and advantages of this invention will become apparent from the remaining portions of the specification.

DETAILED DESCRIPTION

Figure 1:
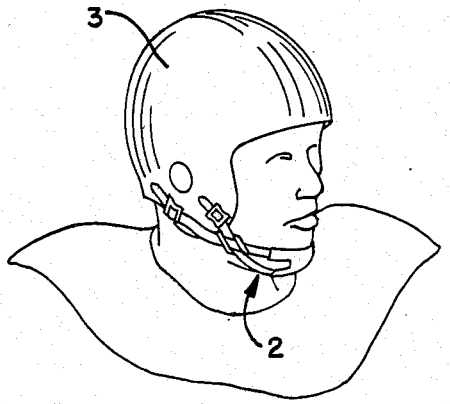
FIG. 1 is a perspective view of an adjustable chin strap showing its use with an athletic helmet according to an embodiment of the invention.
Figure 2:
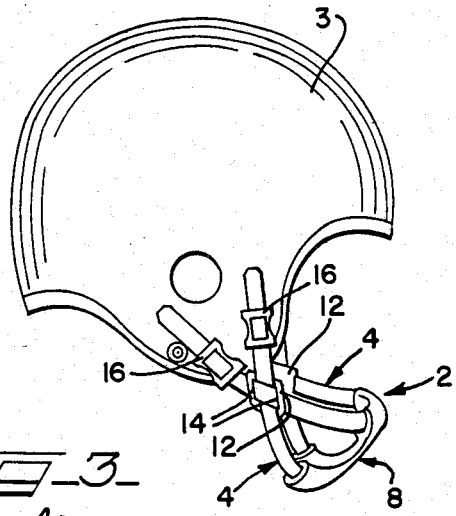
FIG. 2 is a side view of an adjustable chin strap attached to an athletic helmet according to said embodiment of the invention.

FIGS. 1 and 2 illustrate the manner in which the chin strap according to the present invention is used. As shown, the chin strap 2 is attached to a helmet 3. A flexible chin cup 8 is provided and is slideably secured to dual support straps 4. In particular, the cup defines a pair of hem portions 10 through which the straps 4 extend.

Figure 3:
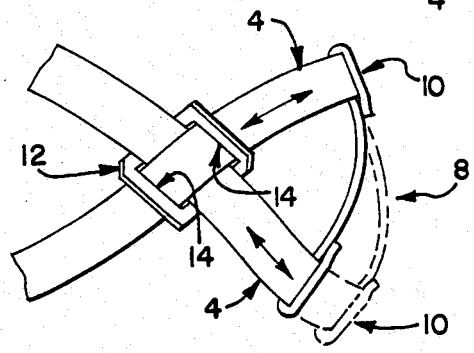
FIG. 3 is an enlarged partial side view showing the relationship between the support straps and a slideable adjustment piece; and, FIG. 4 is an enlarged front elevational view showing the relationship between the chin cup, the support straps and the slideable adjustment pieces.
Figure 4:
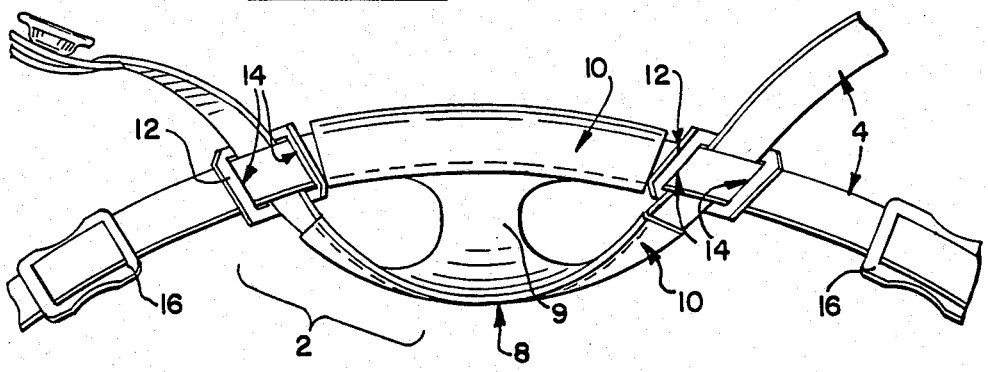

As best shown in FIGS. 3 and 4, both of said support straps 4 extend laterally from chin cup 8 so that the chin cup 8 may be slideably secured along the approximate center portion of each of the support straps 4. The support straps 4 intersect on both sides of flexible chin cup 8 through slideable adjustment pieces 12.

The slideable adjustment pieces 12 each comprise a slider. The slider defines a pair of parallel through-extending slots 14 located at opposing sides thereof. Both of the adjustment pieces 12 are slideably attached to one of the support straps 4 on opposite sides of the chin cup 8 by extending the support strap 4 through both slots 14. The second strap 4 extends between the first strap 4 and the adjustment piece 12. The adjustment pieces 12 are preferably made of a flexible, soft material. Four slideable snaps 16 are provided to secure the ends of the attachment straps 4 to an athletic helmet.

In accordance with the practice of this invention, the angle of the flexible chin cup 8 is adjusted by moving the support straps 4 as indicated by the arrows on said straps 4 relative to the adjustment piece 12 shown in FIG. 3. The slideable adjustment piece 12 may be moved along the length of either or both support straps 4 to accomplish the desired adjustment. As the solid and dotted line illustrations indicate, the angle of the chin cup 8 is adjusted by moving the adjustment piece 12 either away from the chin cup 8 or closer to the chin cup 8.

Referring now to FIG. 4, the chin cup member 8 is shown according to an embodiment of the invention. The chin cup member 8 comprises a flat piece of flexible material which is shaped to include a narrow center portion 9 and two transversely extending hem portions 10. The hem portions 10 are on opposite sides of the center portion 9. The support members 4 are received in said hem portions 10 thereby allowing the chin cup member 8 to be slideably adjusted by moving the chin cup member 8 relative to the support members 4 to achieve maximum comfort.

The chin cup, support straps and adjustment pieces may be made out of any sturdy, flexible material such as vinyl, leather or the like. However, if the support straps are made out of plastic or other artificial material, it is desirable to longitudinally reinforce the straps with a strong fiber or fabric material. The attachment snaps can be made out of any strong, rigid material.

In use, the snaps 16 will ordinarily be placed in the same position for all wearers. After attachment to the helmet, the wearer will then operate adjustment pieces 12 until the most comfortable angle for chin cup 8 is achieved. The chin cup itself can then be moved relative to straps 4 if desired, this final attitude and position of the chin cup being variable depending on the size and shape of the wearer's chin. The snaps 16 provide additional versatility for cases where the most comfortable fit cannot be achieved with the other adjustments.

By sliding the support straps 4 relative to the attachment snaps 16, the user can adjust the over-all fit of the chin strap assembly 2. Sliding the four support straps 4 in one direction relative to the attachment snaps 16 will achieve a more snug fit. Sliding the four support straps 4 in the opposite direction relative to the attachment snaps 16 will achieve a looser over-all fit. Additionally, comfort may be maximized by adjustment of individual support straps 4 relative to the attachment snaps 16.

By providing a flexible chin cup with dual support straps intersecting through slideable adjustment pieces, the wearer of the chin strap described herein can adjust the attitude and angle of the chin cup to optimize comfort and fit. Most significantly, this adjustment takes place while the wearer has the helmet on his head so that he can determine the best fit with maximum convenience. Further, the position of the chin cup may also be adjusted laterally while the helmet is being worn.

It will be understood that changes may be made in the details of construction, arrangement and operation without departing from the spirit of the invention, especially as defined in the following claims.

That which is claimed is:

1. An adjustable chin strap assembly for athletic helmets comprising:

a chin cup member;

two support members slideably supporting said chin cup member;

two slideable adjustment means situated on opposite sides of said chin cup member, said support members each being connected to each of said adjustment means for adjusting said chin strap assembly; and, attachment means for securing said support members to an athletic helmet;

whereby the chin strap assembly can be adjusted by moving said support members relative to said slideable adjustment means and relative to said attachment means and by moving said chin cup member relative to said support members while the helmet is being worn to provide optimum comfort and fit.

2. The device of claim 1 wherein said chin cup member comprises a flat single piece of flexible material which is shaped to include a narrow center portion and two wider transversely extending hem portions on opposite sides of said center portion, said support members being received in said hem portions.

3. The device of claim 1 wherein said two support members comprise two flexible straps slideably attached to said chin cup member, the outer ends of said straps supporting said attachment means for securing the chin strap assembly to an athletic helmet.

4. The device of claim 1 wherein said two slideable adjustment means each comprise a slider, said slider defining parallel through-extending slots at each end thereof, said adjustment means each being slideably attached to one of said support members on opposite sides of said chin cup member by extending said one support member through both slots in said adjustment means, the second support member extending between said first support member and said adjustment means thereby allowing slideable movement of the support members relative to the respective adjustment means on each side of said chin cup member for adjusting the attitude of said chin cup member.

5. The device of claim 4 wherein said adjustment means comprise flexible sliders.

6. The device of claim 1 wherein said attachment means comprise four snaps, one each of said snaps being slideably attached to each end of said support members for releasibly securing said chin strap assembly to an athletic helmet.

* * * * *